US007690884B2

(12) United States Patent
Schwetz et al.

(10) Patent No.: US 7,690,884 B2
(45) Date of Patent: Apr. 6, 2010

(54) FINGER AND DISK FOR SEPARATING PLATE-SHAPED OBJECTS, PARTICULARLY BATTERY PLATES

(76) Inventors: Anton Schwetz, Nörning 72, A-8273 Ebersdorf (AT); Thomas Rotbart, Oberer Kögelruhweg 19, A-8190 Birkfeld (AT); Hans Schnur, A-8273, Ebersdorf (AT); Friedrich Ilgoutz, Lobissergasse 10, A-9170 Ferlach (AT)

( * ) Notice: Subject to any disclaimer, the term of this patent is extended or adjusted under 35 U.S.C. 154(b) by 250 days.

(21) Appl. No.: 11/632,277

(22) PCT Filed: Jun. 13, 2005

(86) PCT No.: PCT/AT2005/000211

§ 371 (c)(1),
(2), (4) Date: Jul. 16, 2007

(87) PCT Pub. No.: WO2006/005089

PCT Pub. Date: Jan. 19, 2006

(65) Prior Publication Data

US 2008/0069682 A1 Mar. 20, 2008

(30) Foreign Application Priority Data

Jul. 12, 2004 (AT) ..... A 1175/2004

(51) Int. Cl.
*B65G 59/02* (2006.01)
*B65H 3/32* (2006.01)

(52) U.S. Cl. ..... 414/797.3; 414/797; 271/113; 271/101

(58) Field of Classification Search ..... 198/418.8, 198/419.3, 626.5, 817; 221/210, 211, 10.09, 221/104, 111, 113, 115, 117, 121, 122, 283; 414/795.8, 796, 796.5–796.9, 797, 797.3, 414/798.2; 451/333
See application file for complete search history.

(56) References Cited

U.S. PATENT DOCUMENTS 2,217,983 A * 10/1940 Hopkins ..... 209/595
2,799,497 A * 7/1957 Novick ..... 271/2
3,702,187 A * 11/1972 Hageman et al. ..... 271/101
4,312,617 A * 1/1982 Livingston et al. ..... 414/795.8
4,439,097 A 3/1984 Mebus et al.
4,516,762 A 5/1985 Moltrasio et al.

(Continued)

FOREIGN PATENT DOCUMENTS

EP 445496 A1 * 9/1991

(Continued)

*Primary Examiner*—Gregory W Adams
(74) *Attorney, Agent, or Firm*—Young & Thompson

(57) ABSTRACT

A device for separating battery plates from stacks comprises a lifting device (30) with which vertical stacks (14) are gradually lifted to a plate placer (51). The plate placer (51) lifts the uppermost plate from the stack (14) and places it onto a conveyor belt (60), whose loading end is located underneath the plate placer (51) and which comprises conveying elements (61) that are moved underneath the plate placer (51) after a plate has been lifted from the stack (14). The delivery end of the conveyor belt (60) is situated underneath the loading end of a vacuum conveyor belt (70). The vacuum conveyor belt (70) receives separated plates from the conveyor belt (60) and moves them to devices located downstream.

30 Claims, 11 Drawing Sheets

U.S. PATENT DOCUMENTS

Figure 1:
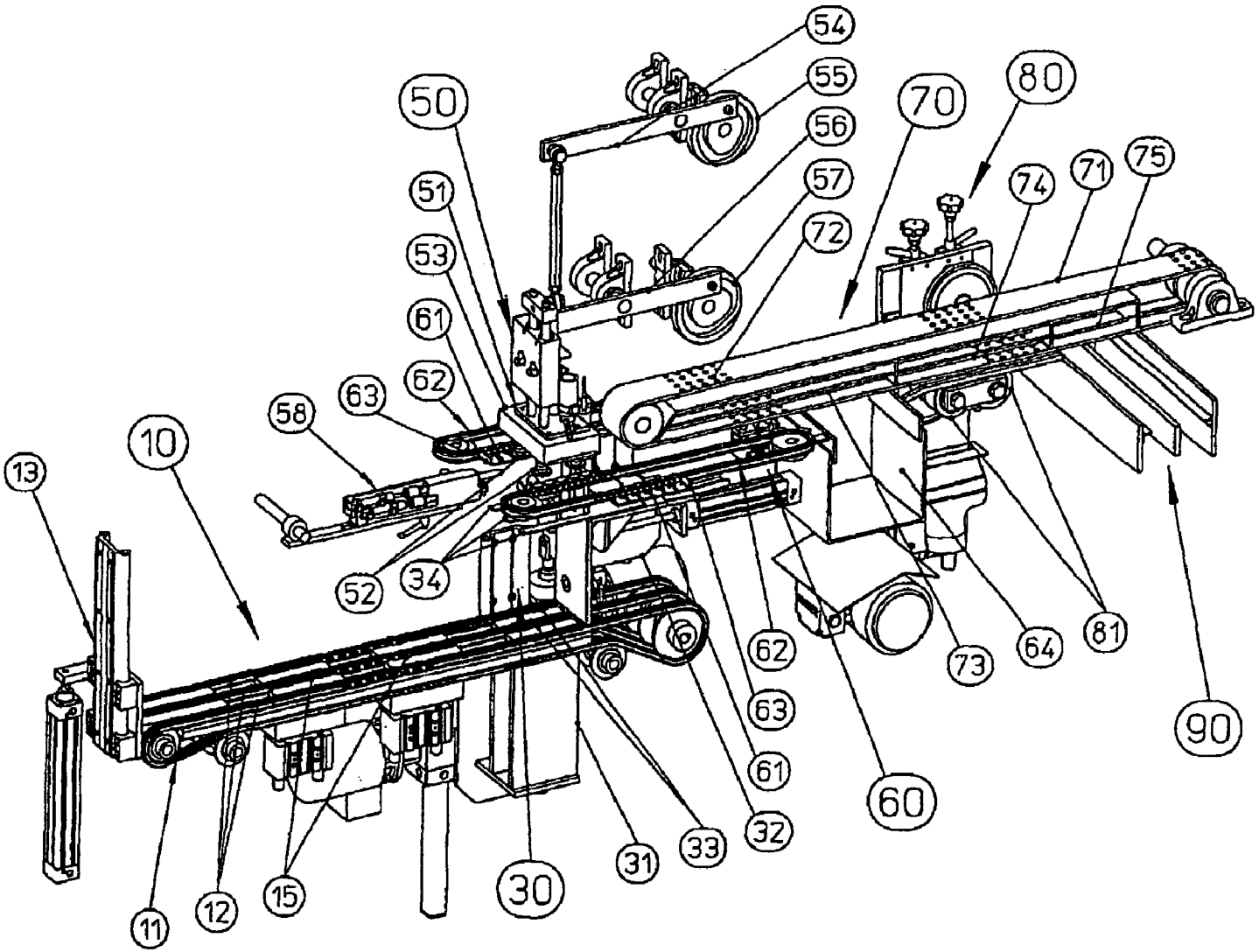

| | | | | | |
|---|---|---|---|---|---|
| 5,052,672 | A | * | 10/1991 | Horii | 271/9.05 |
| 5,664,786 | A | * | 9/1997 | Buschhaus et al. | 271/10.09 |
| 6,419,217 | B1 | * | 7/2002 | Hartmann et al. | 270/52.12 |
| 6,691,856 | B1 | * | 2/2004 | Prakken | 198/419.3 |
| 2003/0012636 | A1 | | 1/2003 | Takayuki et al. | |

FOREIGN PATENT DOCUMENTS

| | | | | |
|---|---|---|---|---|
| GB | 2092117 | A | * | 8/1982 |
| JP | 2003261212 | A | * | 9/2003 |

* cited by examiner

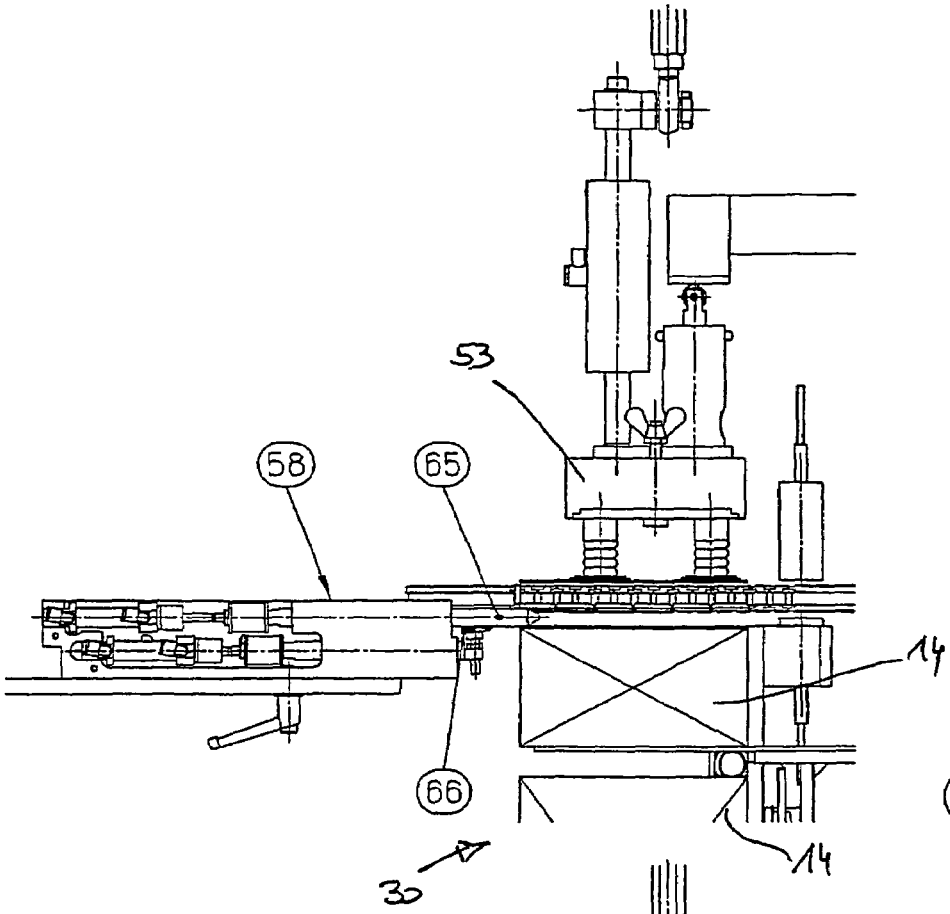
Fig. 9.1
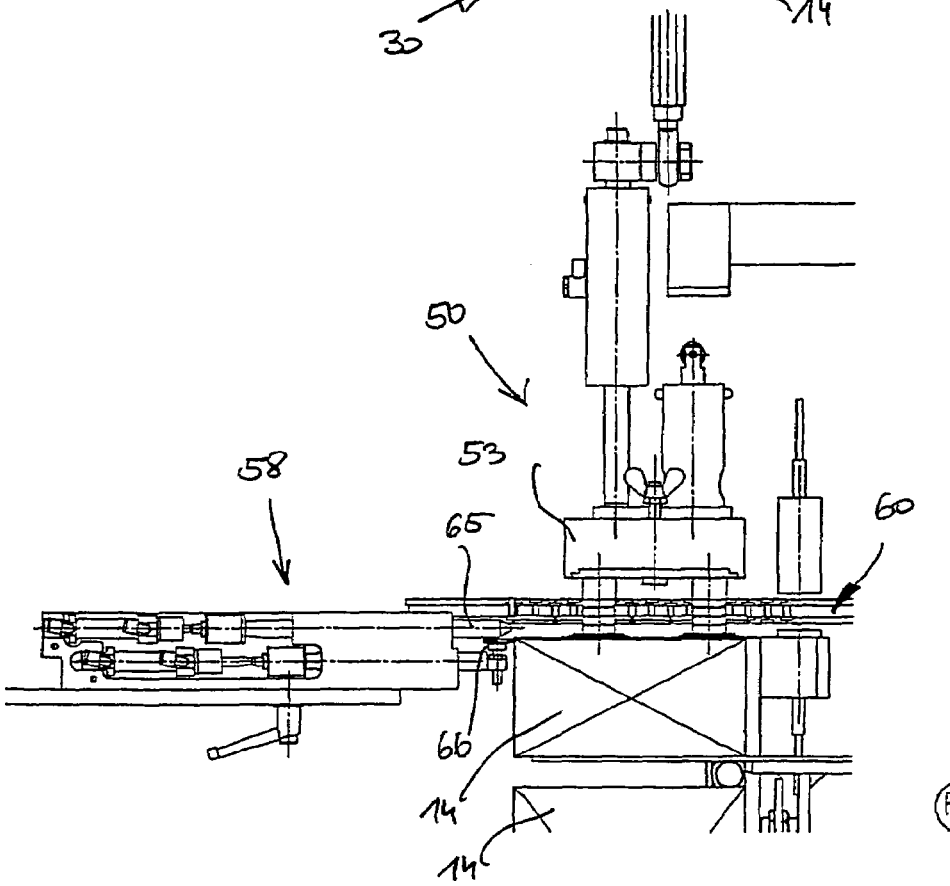
Fig. 9.2

FINGER AND DISK FOR SEPARATING PLATE-SHAPED OBJECTS, PARTICULARLY BATTERY PLATES

The invention relates to a device with the features of the introductory part of claim 1.

Devices are known for separating plate-shaped articles, especially battery plates, from stacks of these plate-shaped articles.

In older suggestions for devices for removing battery plates from stacks of these battery plates (compare AT 241 565 B, AT 329 124 B and AT 352 198 B) the battery plates are arranged in essentially vertical stacks in which the plates are aligned essentially horizontally, and are removed from the stack from underneath. This is a problem due to the weight of the stack which loads the plate which is bottommost at the time, since it happens that the battery plates adhere to one another and cannot be easily removed individually.

Therefore devices have also been suggested in which battery plates standing essentially vertically in horizontally aligned stacks are supplied to the removal site.

For example, reference is made to EP 0 141 806 B, EP 0 608 678 A and AT 405 824 B.

In these known devices the plates to be separated, standing essentially vertically in horizontally aligned stacks, are supplied to a separating device with a gripper which removes plates individually from the stack. This causes complex kinematics of the gripper ("plate handler") which removes individual plates from the stack and places them on a conveyor belt.

The disadvantage in these known devices is that due to the complex movements of the removal grippers which are designed to remove the plates individually from horizontal stacks, these devices are limited with respect to their performance.

US 2003/0012636 A discloses a device for separation of plate-shaped articles from vertical stacks, the stack being worked from overhead. Stacks supplied by a conveyor are raised by lever devices. The upper end of the stack is assigned a removal gripper which is equipped with suction heads and which executes vertical movements via a drive. The plate which has been raised by the removal gripper with its suction heads from the upper end is transferred to one of four suction boxes which are located on a rotating wheel. The plates are then placed on another conveyor belt by these suction boxes, their executing a 180° turn in their movement between the feed point in the region of the removal gripper and the delivery site.

According to DE 32 02 087 A a vertical stack is processed from overhead, when the plates are lifted off the stack a movement pointed upward being executed. There is a continuous conveyor belt with suction heads supplied with negative pressure thereon for processing. This conveyor belt transports the removed plates (individually) to another conveyor with which separated plates are moved away. One deflection roll of the conveyor belt with the suction heads, specifically the deflection roll which is located in the region of the stack, is supported to be able to move back and forth in a carriage. The invention proceeds from this prior art.

U.S. Pat. No. 4,516,762 A relates to a device for picking up and removing individual bags from a stack, and these bags are to be supplied to a bag filling machine. Stacks of bags are delivered on a conveyor and positioned underneath the bag removal device. In addition to the conveyor for stacks of bags, there is a second conveyor for separated bags. To raise individual bags there is a device which is equipped with suction heads and which can move simply back and forth. When a bag has been lifted off the stack, fingers from both sides are moved to under the raised bag and then the bag is moved by the movable device which bears the fingers with clamping laterally over the conveyor and deposits it on the latter.

DE 40 05 144 A describes a sheet handler in which on a carrier which can be moved up and down there are a separating suction box and at least one row of drag suction boxes on a carrier which can move back and forth. No agreements with the article of the application can be recognized.

U.S. Pat. No. 4,439,097 A relates to a means with which separating sheets are to be inserted between bundles of magazines. In this connection the separating sheets are picked up by a gripper and placed on a conveyor which inserts them between layers of magazine bundles.

The object of the invention is to devise a device of the initially Named type with which shorter cycle times are possible when plates, especially (lead) plates for batteries and accumulators, are being removed from stacks.

This object is achieved as claimed in the invention with a device which has the features of claim 1.

Preferred and advantageous embodiments of the invention are the subject matter of the dependent claims.

Since in the device as claimed in the invention the plate which is uppermost at the time is removed from a stack of essentially horizontally lying plate-shaped articles, which stack is aligned essentially vertically, a simple movement of the removal gripper ("plate handler") is possible. In this way, when plates are being separated from stacks of such plates and when the separated plates are being transferred to conveyor means, short cycle times are achieved.

In particular, the device as claimed in the invention is suited for separating battery or accumulator plates delivered in stacks, and the separated plates then can be supplied to further processing, for example for brushing of contact lugs, and to devices for jacketing of battery or accumulator plates.

Other details, features and advantages of the device as claimed in the invention will become apparent from the following description of one preferred embodiment using the drawings.

Figure 2:
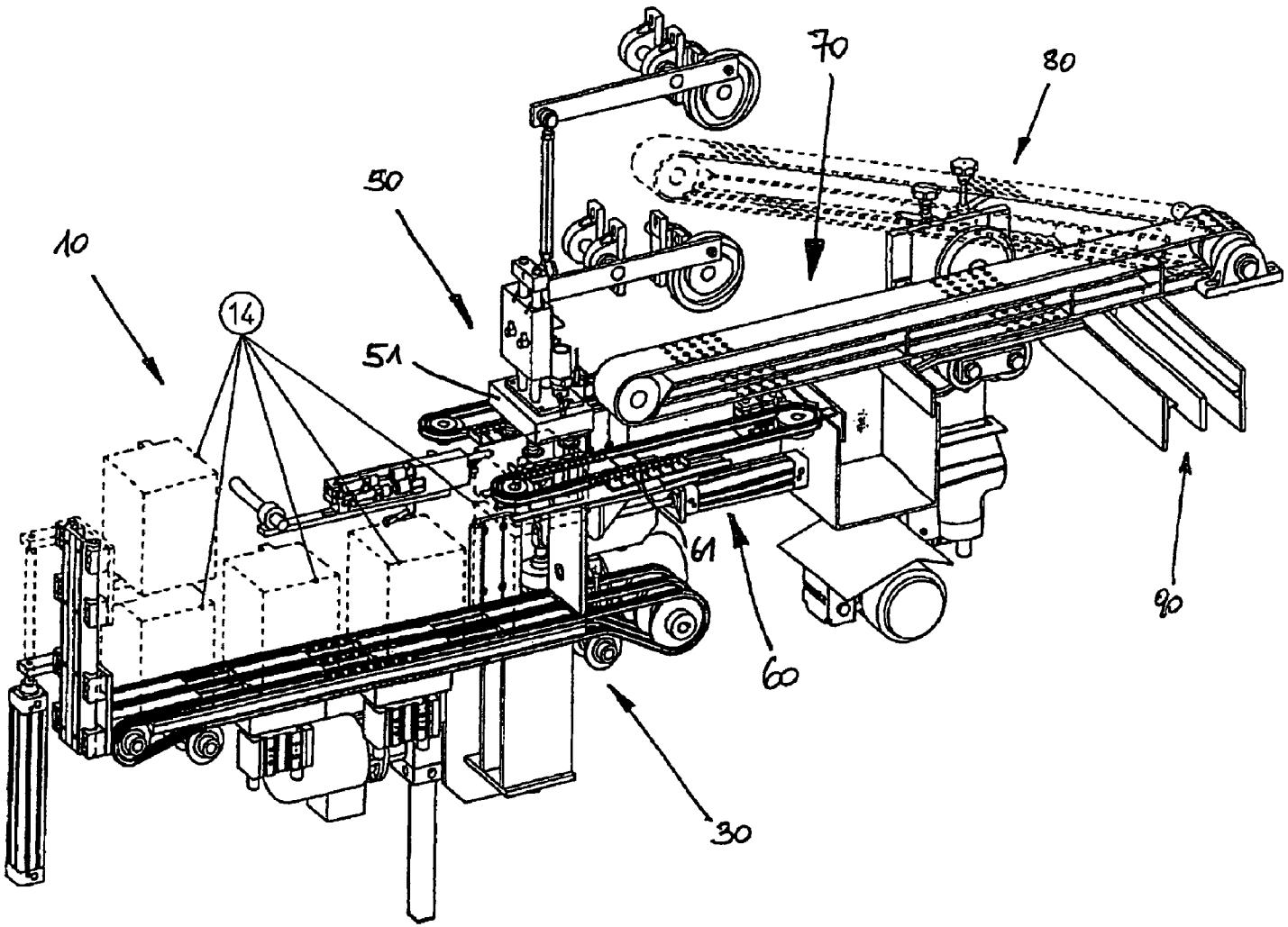
Figure 3:
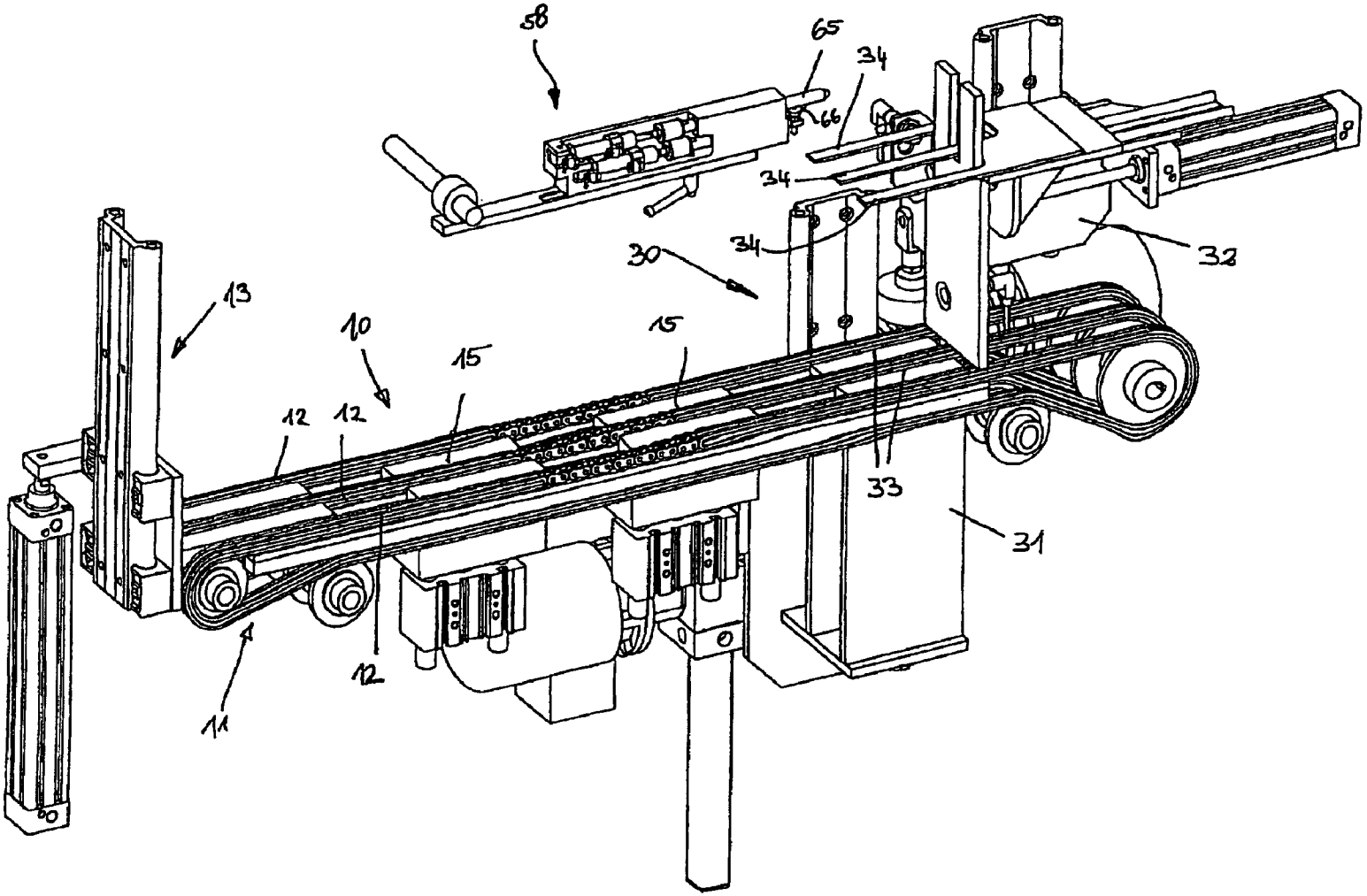
Figure 4:
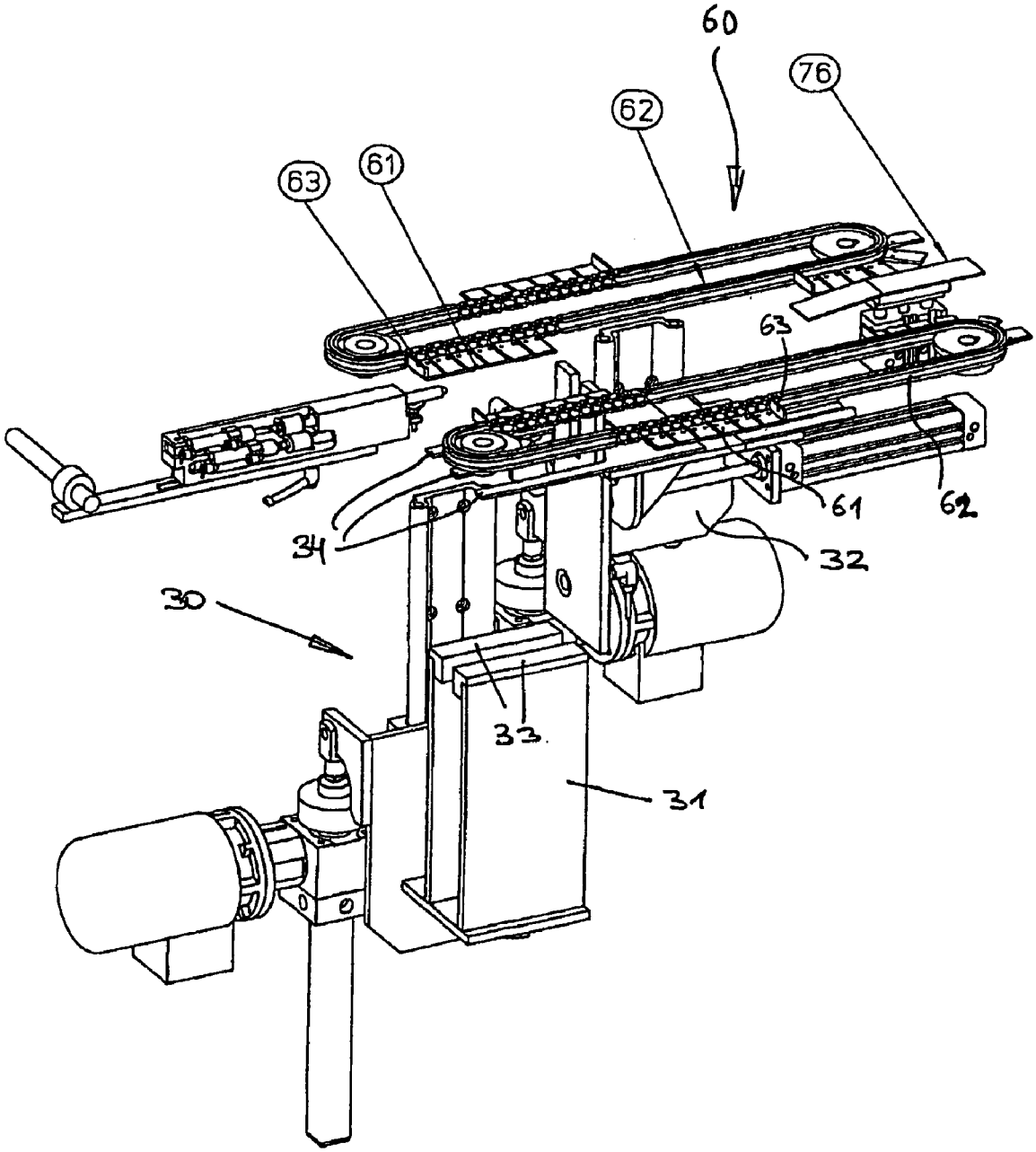
Figure 5:
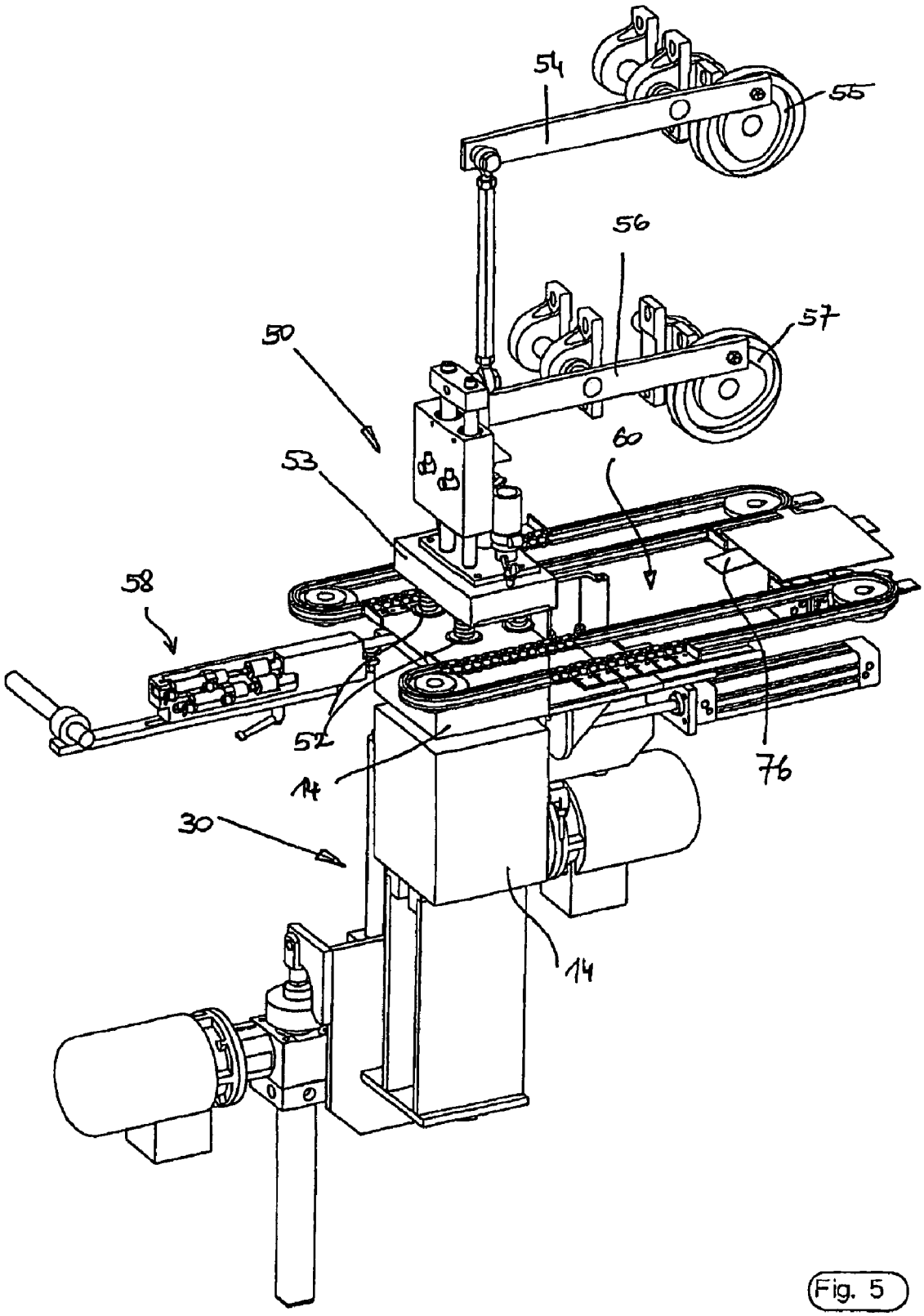
Figure 6:
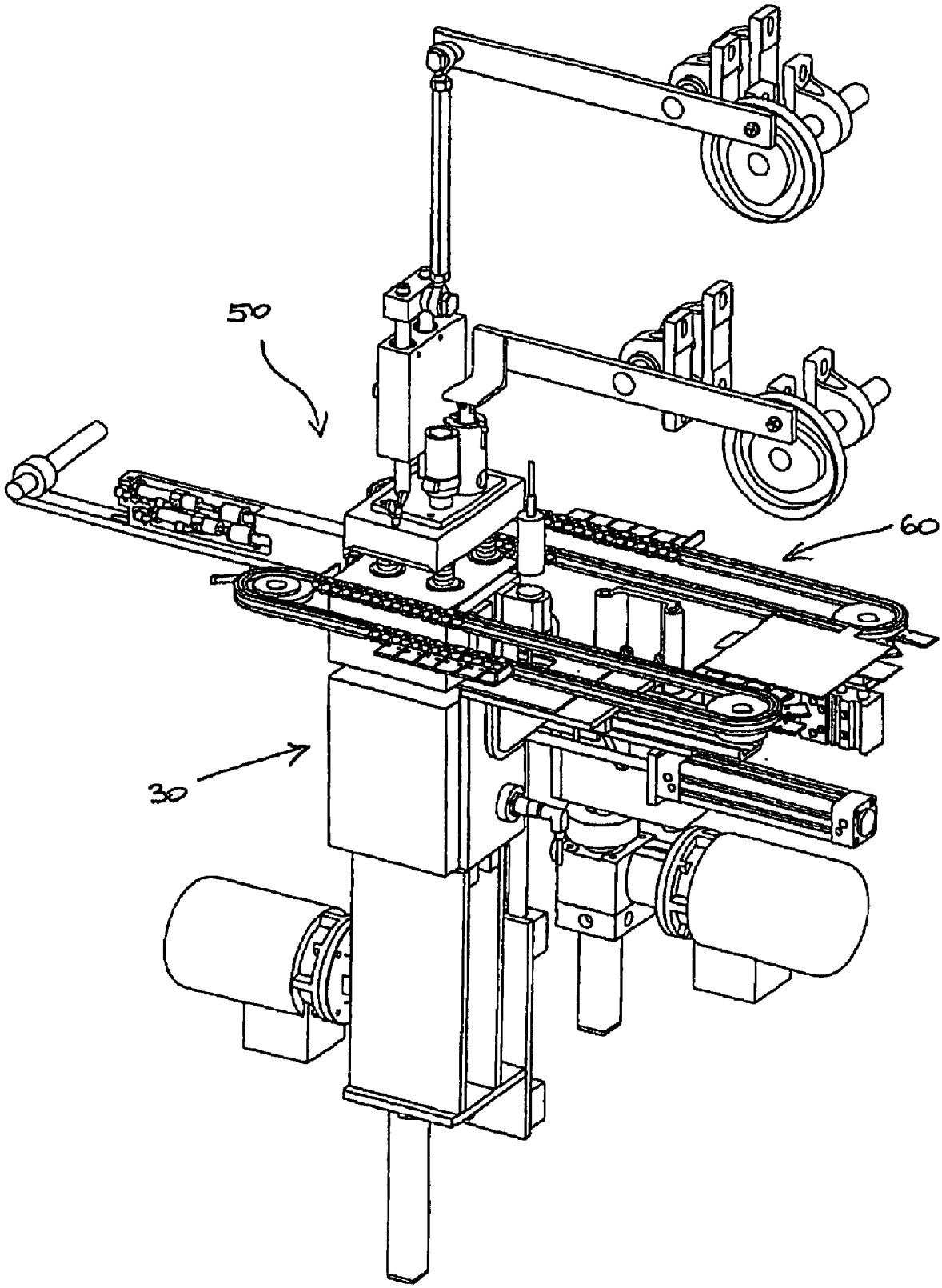
Figure 7:
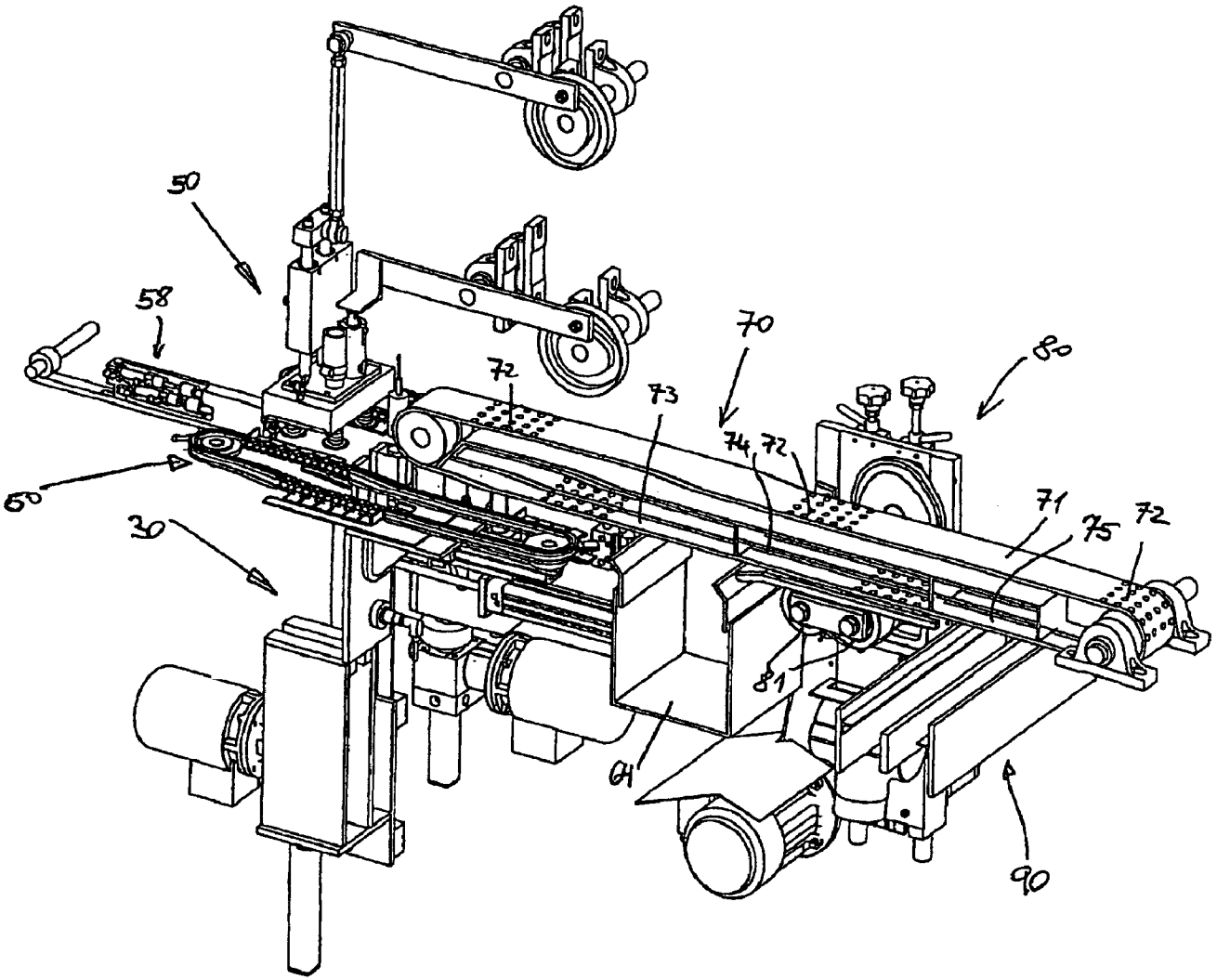
Figure 8:
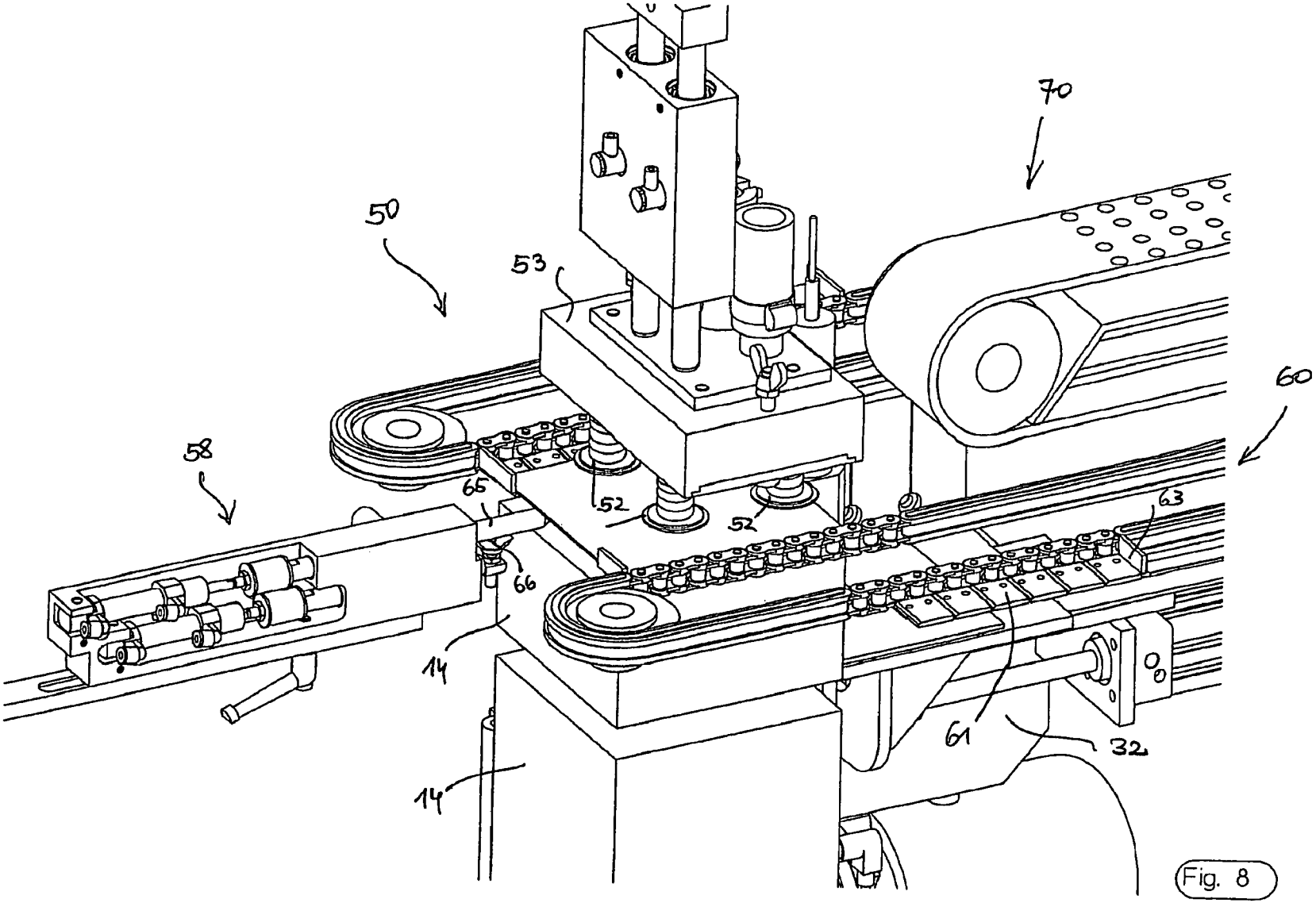
Figure 10:
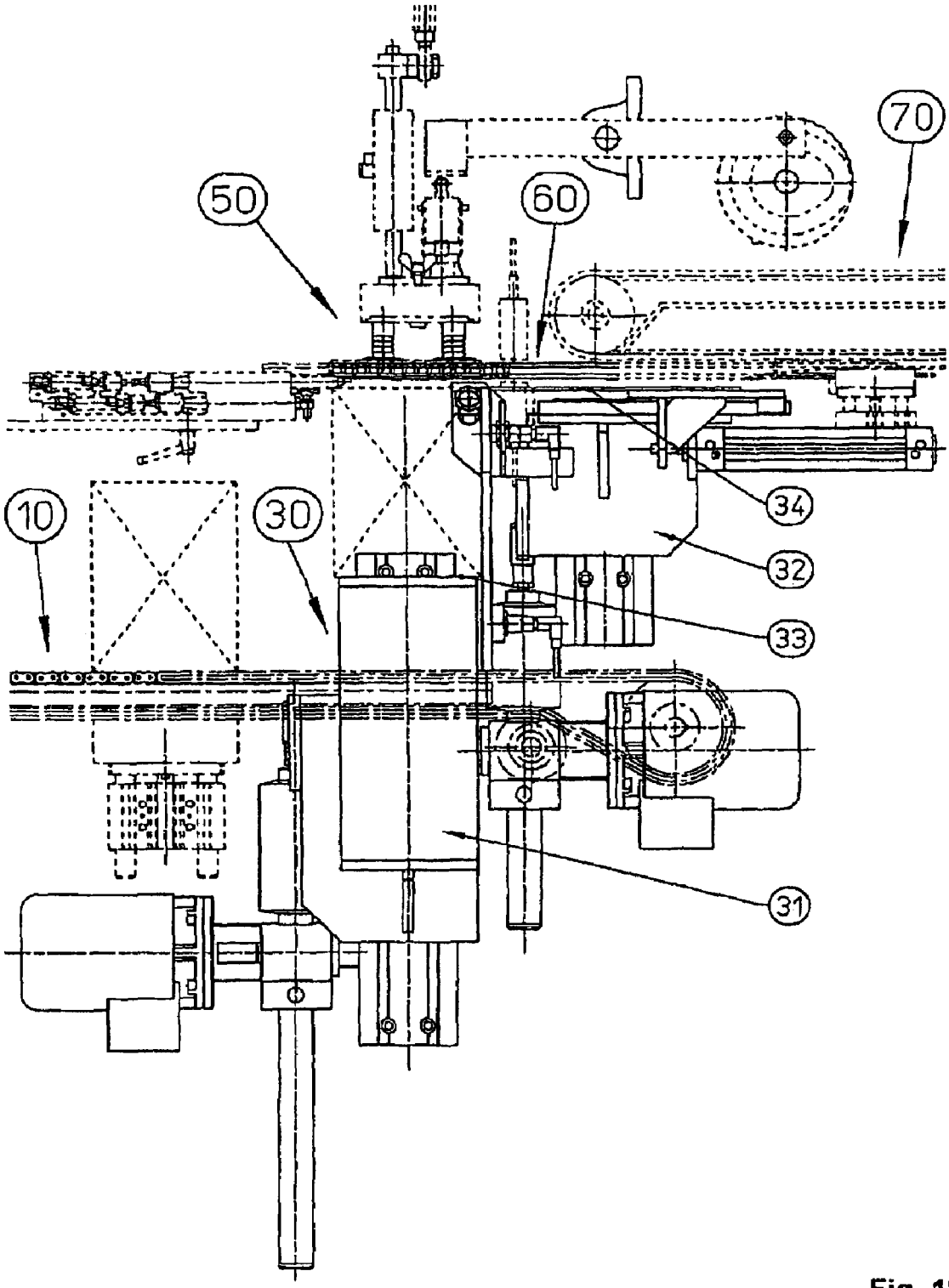
Figure 11:
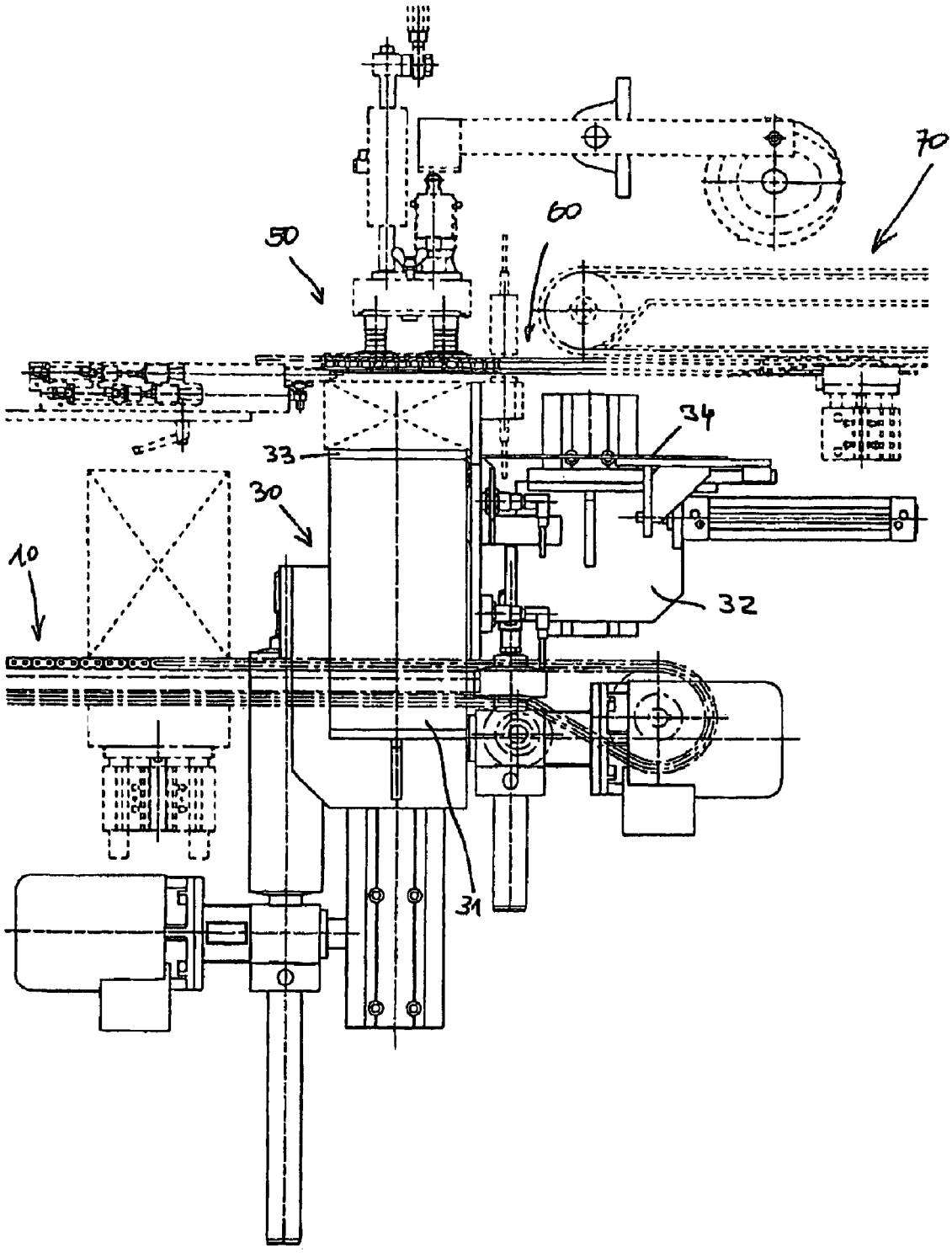

FIG. 1 schematically shows a device as claimed in the invention in an oblique view, FIG. 2 shows the device from FIG. 1 with stacks or package of (battery) plates shown symbolized, FIG. 3 shows a detail of the device in the region of the conveyor belt for delivering stacks, FIG. 4 shows in an oblique view a detail (without the plate handler) in the region of the transfer to a transport means ("intermediate conveyor") for separated plates, FIG. 5 shows a detail of the device as claimed in FIG. 4 with stacks of (battery) plates located in it, FIG. 6 shows the detail of the device from FIG. 5 in a different view, FIG. 7 shows another detail of the device from FIG. 1 in the region of a vacuum belt located following the separating device, FIG. 8 shows another detail of the device from FIG. 1 in the region of separation of the plates from the stacks, FIG. 9.1 shows the detail from FIG. 8 in a side view, FIG. 9.2 shows the detail from FIGS. 8 and 9 in a side view in another operating position, and FIGS. 10 and 11 show lifting tables in various positions in a side view.

The device as claimed in the invention as is shown in FIGS. 1 and 2 has a conveyor belt 10 for delivery of stacks of plates, especially positive and/or negative (lead) plates for batteries and accumulators, and a device 30 located following this conveyor belt 10 (stack feeder belt) for lifting stacks to the separation station 50 with a plate handler 51 and a device 58 for separating plates. Connected to the separation station 50 there is a vacuum conveyor belt 70 (vacuum belt) with which the plates which have been separated in the separation station 50 and which have been deposited on an intermediate conveyor 60 are supplied to the main conveyor path 90.

The individual assemblies of the device are described below:

The stack feeder belt 10 is for example a belt or chain conveyor 11 with three conveyor elements 12 (belts or chains) in the embodiment, on which in the area of the ends of the upper strands of the conveyor elements 12 which are moving to the right in FIG. 1, which ends are on the left in FIG. 1, stacks 14 (FIG. 2) of plates are placed by any device 13. Two lifting devices 15 are assigned to the upper strands of the conveyor elements 12 of the stack feeder belt 10 and can lift stacks 14 located on the feeder belt 10 off the conveyor elements 12 for stopping the stack 14 so that they can be supplied in order and at a distance from one another to the lifting device 30 which is located on the delivery-side end of the stack feeder belt 10.

The lifting device 30 (compare FIGS. 10.1 and 10.2) has two lifting tables 31 and 32 which can be actuated independently of one another, of which one 31 in its lower initial position is located in the lower region, therefore essentially at the height of the upper strands of the conveyor elements 12 of the stack feeder belt 10. This lower lifting table 31 in the embodiment has two fingers 33 which in the lower end position fit between the conveyor elements 12 (chains, belts or straps) of the stack feeder belt 10.

The second lifting table 32 is located in the upper region of the lifting device 30. On the upper lifting table 32 there is at least one blade 34 which can be moved back and forth into the lifting path—preferably there are three blades 34 which can fit between the fingers 33 of the lower lifting table 31—in order to take a partially worked stack 14 off the lower lifting table 31.

In this way stacks 14 in the lifting device 30 can be raised off the lower lifting table 31, until the uppermost plate is in the removal position. When some of the plates have been removed from the stack 14, it therefore has been partially worked, the blades 34 of the upper lifting table 32 are advanced and hold the partially worked stack 14 so that the lower lifting table 31 can be lowered and the stack 14 which is smaller in between is taken from the upper lifting table 32 and can be further raised in steps off this lifting table 32.

By the interplay of the lower lifting table 31 and the blades 34 of the upper lifting table 32 which can likewise be raised, which blades 34 can move back and forth into the lifting path, continuous feed of plates into the removal position of the separation station 50 is possible.

The separation station 50 has a plate handler 51 which lifts the plate of the stack which is uppermost at the time using suction heads 52 which are supplied with negative pressure via the housing 53 of the plate handler 51, and deposits it on the conveyor elements 61 ("fin group") of a finned conveyor belt 60 which is used as an intermediate conveyor. The vertical movements of the plate handler 51 are controlled via a lever rod 54 and control cams 55 or lifters so that it remains raised as long as required, specifically until the next fin group 61 of the finned conveyor belt 60 has been moved into the position for taking a plate from the plate handler 51. The delivery point, therefore the location at which the plates are deposited individually on an opposing pair of fin groups 61 of the finned conveyor belt 60 which is used as an intermediate conveyor, is located in the region of the plate handler 51 so that it need only execute vertical movements if it picks up one plate from the stack 14 and then deposits it on a pair of fin groups 61 of the finned conveyor belt 60.

The plate handler 51 has a housing 53 with several—in the embodiment, four—suction heads 52 which can be supplied with negative pressure. To deliver a plate which has been lifted by the plate handler 51 to the finned conveyor belt 60 there is a cam-controlled (rod 56, cam plate 57) valve which lets "entrained air" into the housing 53 of the plate handler 51 so that the plate held by it drops onto a pair of fin groups 61 of the finned conveyor belt 60, specifically the pair which is located under the plate handler 51.

To ensure that only one plate at a time is raised off the stack 14 by the plate handler 51, the separation station 50 is assigned a device for plate separation 58. This plate separation 58 has a finger 65 which can be moved back and forth, and a disk 66 which is located at a distance equal to the plate thickness under the finger 65 and which can likewise be moved back and forth (compare FIGS. 9.1, 9.2).

A stack 14 is raised either off the lower lifting table 31 or off the upper lifting table 32 so far that the uppermost plate from underneath adjoins the advanced finger 65 of the plate separation 58. As soon as this has happened, the disk 66 is advanced and penetrates into the gap between the uppermost plate and the one next underneath, so that the upper plate is reliably separated from the underlying plate and is lifted by the plate handler 51 using its suction heads 52 and can be deposited on the finned conveyor belt 60.

Plates are moved individually to the right in FIG. 1 by the finned conveyor belt 60.

The finned conveyor belt 60 has two endless chains 62 which rotate around two deflection wheels at a time with perpendicular axes, of which endless chains at a distance from one another there are support fins 61 for the plates ("fin groups") projecting from the endless chains 62 into the space between the endless chains 62. In each fin group 61 on their end which is the back end in the direction of motion there are stop angles 63 for reliable transport of plates. In the region in which the strands of the endless chains 62 are moved in FIG. 1 to the right, therefore in the conveyer direction of the finned conveyor belt 60, there are two fin groups 61 opposite one another and they form a pair of fin groups 61, resting on which a plate is transported away from the separation station 50 (compare FIGS. 5 and 6).

In the area following the plate handler 51, the finned conveyor belt 60 is assigned a device for recognizing (unwanted) double plates (two plates lying on one another). If a "double plate" is established, it is ensured that these plates on the end of the finned conveyor belt 60 are dumped into an ejection shaft 64. This can take place for example in that the first vacuum chamber 73 of a downstream vacuum conveyor belt 70 is not negatively pressurized, so that the vacuum conveyor belt 70 cannot pick up "double plates" delivered from the finned conveyor belt 60. Alternatively or in addition, in the region of the delivery-side end of the finned conveyor belt 60 there can be a lifting device 76 which lifts individual plates to the delivery-side end of the vacuum conveyor belt 70 so that they can be picked up by the vacuum conveyor belt 70, or is not activated when "double plates" are recognized, so that double plates drop into the ejection shaft 64.

The vacuum conveyor belt 70 is provided with overlapping to the delivery-side end of the finned conveyor belt 61. The vacuum conveyor belt 70 has an endless belt 71 with several groups 72 of holes located in it, and several vacuum chambers 73, 74, 75 assigned to the lower strand of the belt 71 which is moving from left to right in FIG. 1. The vacuum chambers 73, 74, 75 can be supplied with negative pressure individually and independently of one another. The vacuum conveyor belt 70, optionally supported by the lifting means 76 from the delivery-side end of the finned conveyor belt 60, picks up the separated plates and transports them to the right in FIG. 1. The movements of the finned conveyor belt 60 and of the vacuum conveyor belt 70 are matched to one another such that one plate resting on a pair of fin groups 61 always arrives at the end of the finned conveyor belt 60 when a group 72 of holes of the endless belt 71 of the vacuum conveyor belt 70 is located on the delivery-side end of the finned conveyor belt 60.

The vacuum conveyor belt 70 can be pivoted up into the position shown in FIG. 2 by the broken line for maintenance purposes or for correcting faults.

The lower strand of the belt 71 of the vacuum conveyor belt 70 in this embodiment is assigned a means 80 for brushing the contact lugs of battery or accumulator plates. In the region of this means 80 there are clamping rolls 81 which are assigned to the lower strand of the vacuum conveyor belt 70 which clamping rolls 81 ensure by their pressing the plates from underneath against the endless belt 71 that the plates do not execute any unwanted movements and continue to move reliably when their tabs are being brushed.

The delivery-side end of the vacuum conveyor belt 70 is assigned a main conveyor path 90 for removing separated plates such as battery or accumulator plates. The vacuum chamber 75 of the vacuum conveyor belt 70 provided in the region of the main conveyor path 90 can be vented so that the vacuum in it is cancelled and the groups 72 of holes provided in the vacuum belt 70 in this region are not supplied with negative pressure, so that a plate which has arrived from the vacuum conveyor belt 70 on its bottom strand held by the negative pressure over the main conveyor path 90 is released and drops onto the main conveyor path 90.

The main conveyor path 90 can be a conveyor path to a device for jacketing of battery or accumulator plates, as are conventionally known from U.S. Pat. No. 6,499,208 A or U.S. Pat. No. 6,670,072 A.

In summary, one embodiment of the invention can be described as follows:

A device for separating battery plates from a stack has a lifting device 30 with which vertical stacks 14 are gradually lifted to a plate handler 51. The plate handler 51 lifts the plate which is uppermost at the time off the stack 14 and places it on a conveyor belt 60 with a delivery-side end which is located under the plate handler 51 and which has conveyor elements 61 which are moved to under the plate handler 51 after lifting the plate off the stack 14. The delivery-side end of the conveyor belt 60 is located under the delivery-side end of a vacuum conveyor belt 70. The vacuum conveyor belt picks up separated plates from the conveyor belt 60 and moves them to the downstream devices.

The invention claimed is:

1. A device for separating plate-shaped articles arranged in an essentially vertically aligned stack (14), said plate-shaped articles aligned and lying essentially horizontally and the stack (14) extending from a lower end to an upper end, the device comprising:

a removing means (50) for removing an individual plate-shaped article from one end of the stack (14), the removing means (50) configured to remove an uppermost first plate-shaped article from a top of the stack (14); and a separating device (58) provided with the removing means (50) including a conveyor device (60) for transporting separated plate-shaped articles removed from the stack (14) by the removing means (50), wherein the separating device (58) also includes a separating finger (65) and a disk (66), the separating finger (65) being spaced at a distance over the disk (66), and the disk (66) configured to be operatively inserted into a space between the uppermost first plate-shaped article and a second plate-shaped article immediately underneath the first plate-shaped article.

2. The device as claimed in claim 1, further comprising:

a lifting means (30) for lifting the stack (14).

3. The device as claimed in claim 2, wherein the lifting means (30) is comprised of two lifting tables (31, 32) configured to be actuated independently of one another.

4. The device as claimed in claim 3, further comprising:

a supply conveyor means (10, 11) for delivering the stack (14) of plate-shaped articles toward the removing means (50), wherein a lower lifting table (31) of the two lifting tables is provided at one end of the conveyor means (10, 11).

5. The device as claimed in claim 3, wherein an upper lifting table (32) of the two lifting tables is located in a region of the removing means (50).

6. The device as claimed in claim 4, wherein the supply conveyor means (10, 11) is comprised of a plurality of conveyor elements (12) for conveying the stacks (14) toward the removing means (50), and wherein the lower lifting table (31) has fingers (33) configured to fit between the conveyor elements (12) of the supply conveyor means (10, 11) to lift the stack (14) off the conveyor elements (12).

7. The device as claimed in claim 5, wherein the upper lifting table (32) includes blades (34) configured to move back and forth and further configured to fit between the fingers (33) of the lower lifting table (31).

8. The device as claimed in claim 1, wherein the removing means (50) further includes a plate handler (51), and wherein the conveyor device (60) for transporting the separated plate-shaped articles includes conveyor members (61) configured for moving into a receiving position underneath the plate handler (51).

9. The device as claimed in claim 8, wherein the conveyor members (61) of the conveyor device (60) are fins (61) extending laterally from the conveyor device (60) to support a separated plate-shaped article.

10. The device as claimed in claim 9, wherein the conveyor device (60) also includes two endless chains (62) with the fins (61) grouped thereon.

11. The device as claimed in claim 10, wherein the conveyor device (60) also includes a stop angle member (63) provided rearmost in the conveyor direction for each group of fins (61).

12. The device as claimed in claim 8, wherein the plate handler (51) includes vacuum suction heads (52).

13. The device as claimed in claim 12, wherein the vacuum suction heads (52) are connected to a housing (53) of the plate handler (51) configured to be supplied with negative pressure.

14. The device as claimed in claim 13, wherein the housing (53) is configured to be vented to release a plate-shaped article from the plate handler (51).

15. The device as claimed in one of claims 8, wherein the plate handler (51) includes a drive (54) actuated by one of a lifter and a control cam (55) to move the plate handler (51).

16. The device as claimed in claim 13, further comprising:

a valve configured to be opened and closed by a drive (56) actuated by one of a lifter (57) and a control cam in order to vent the housing (53) of the plate handler (51).

17. The device as claimed in claim 1, further comprising:

a means for detecting double plates provided with the conveyor device (60).

18. The device as claimed in claim 1, further comprising:

a vacuum conveyor belt (70) including a belt (71) overlapping with the conveyor device (60) for further transport of the separated plate-shaped articles.

19. The device as claimed in claim 18, wherein the vacuum conveyor belt (70) includes an upper strand and a lower strand beneath the upper strand, and wherein the vacuum conveyor belt (70) conveys the separated plate-shaped articles on the lower strand by means of negative pressure.

20. The device as claimed in claim 18, wherein the vacuum conveyor belt (70) is configured to be pivoted up from an active position into an inactive position.

21. The device as claimed in claim 18, wherein the belt (71) of the vacuum conveyor belt (70) includes groups (72) of holes configured to be supplied with negative pressure.

22. The device as claimed in claim 18, wherein the belt (71) of the vacuum conveyor belt (70) includes chambers (73, 74, 75) configured to be supplied with negative pressure.

23. The device as claimed in claim 22, wherein the chambers (75) of the vacuum conveyor belt (70) are located on the delivery side and are configured to be vented to deposit the separated plate-shaped articles on a final conveyor path (90).

24. The device as claimed in claim 18, further comprising:

at least one means (80) for processing the separated plate-shaped articles transported on the vacuum conveyor belt (70).

25. The device as claimed in claim 24, wherein the processing means is a device configured to brush contact lugs of battery or accumulator plates.

26. The device as claimed in claim 4, wherein the conveyor means (10, 11) includes at least two conveyor elements (12) aligned parallel to one another and spaced from one another, and wherein the lower lifting table (31) comprises fingers (33), each finger (33) configured to be inserted in a space between the conveyor elements (12).

27. The device as claimed in claim 1, wherein the separating finger (65) of the separation device (58) is configured to be moved back in a retracted mode and forth in an extended mode.

28. The device as claimed in claim 1, wherein the disk (66) of the separation device (58) is configured to be moved back in a retracted mode and forth in an extended mode.

29. The device as claimed in claim 27, wherein the disk (66) is operatively extended into the space between the uppermost first plate-shaped article and the second plate-shaped article when the uppermost first plate-shaped article is caused to adjoin the finger (65) in the extended mode.

30. The device as claimed in claim 1, wherein the distance of the space between the separating finger (65) and the disk (66) corresponds to a thickness of the plate-shaped article.

* * * * *